United States Patent [19]

Tate

[11] Patent Number: 4,627,621

[45] Date of Patent: Dec. 9, 1986

[54] GOLF ACCESSORY

[76] Inventor: John R. Tate, 10869 Portal Dr., Los Alamitos, Calif. 90720

[21] Appl. No.: 774,729

[22] Filed: Sep. 11, 1985

[51] Int. Cl.[4] ..... A45F 5/00

[52] U.S. Cl. ..... 273/32 B

[58] Field of Search ..... 273/32 A, 32 B, 32 D, 273/208, 210, 183 A, 33; D21/234

[56] References Cited

U.S. PATENT DOCUMENTS

| | | | |
|---|---|---|---|
| 3,233,802 | 2/1966 | Ludwick | 273/32 A |
| 3,622,157 | 11/1971 | Hatch | 273/32 A |
| 3,744,542 | 7/1973 | Stephens et al. | 273/32 A |
| 3,774,913 | 11/1973 | Dien | 273/32 A |
| 4,063,731 | 12/1977 | Kitay | 273/33 |
| 4,114,878 | 9/1978 | Hammond | 273/32 A |
| 4,151,937 | 5/1979 | Jarosh et al. | 273/32 A |
| 4,241,917 | 12/1980 | Cohen | 273/33 |
| 4,386,774 | 6/1983 | Buckman | 273/32 A |
| 4,535,987 | 8/1985 | Dikoff | 273/32 A |

*Primary Examiner*—Richard C. Pinkham
*Assistant Examiner*—T. Brown
*Attorney, Agent, or Firm*—Charles H. Thomas

[57] ABSTRACT

A golf accessory is provided which serves both as a divot tool and as a clip. The clip can be used as a means of attachment of the accessory to the belt, cap, shoe or golf bag of a golfer. Alternatively, the clip can be used as a money clip. The accessory includes a looped return behind a disk-shaped body which defines a saddle, facing concave upwardly, and a concave dish. The dish is configured as a spherical segment having a radius equal to the radius of a golf ball, and can be used to check golf balls to detect departures from an ideal perfectly spherical configuration. The disk has a pair of legs which perform the function of a divot repair tool, and which also allow the accessory to be used as a stand to support the grip of a golf club above grass. The configuration of the saddle conforms to the circular arcuate configuration of the face of a golf club and is used to check golf club faces for defects.

15 Claims, 9 Drawing Figures

GOLF ACCESSORY

BACKGROUND OF THE INVENTION

1. Field of the Invention

The present invention relates to a golf accessory which serves as both a divot repair tool and a clip.

2. Description of the Prior Art

Divot repair tools have been available for use by golfers for many years. One such divot repair tool is depicted in U.S. Pat. No. Des. 215,668, issued on Oct. 21, 1969. However, conventional divot repair tools are typically flat, stamped metal structures which, while also functional as key chain weights, are essentially single purpose devices.

SUMMARY OF THE INVENTION

The present invention is a unique golfing accessory which not only serves as a divot repair tool, but which also performs a multiplicity of other functions. The golf accessory of the invention is a metal structure formed with a disk-shaped body having a pair of elongated, generally parallel legs on one side. Unlike conventional divot repair tools, a return is defined on the opposite side of the disk-shaped body and is bent in a loop with an outwardly facing concave saddle, remote from the parallel legs. The return curves back behind the disk-shaped body and terminates in a shallow dish located directly behind the body and facing outwardly therefrom. The dish is formed at a spherical radius which is equal to the radius of a golf ball.

Conventional, regulation golf balls are 1.680 inches in diameter. The U.S. Golfing Association has established that a golf ball is illegal if its diameter is less than the minimum acceptable diameter which currently is 1.680 inches. The outwardly facing dish located behind the disk-shaped body is formed as a segment of a sphere having a diameter of 1.68 inches. The transverse breadth of the dish is seven eighths of one inch across.

When a golf ball is placed upon the dish behind the disk-shaped body of the golfing accessory of the invention, its curvature should conform precisely to the curvature of the dish. Rotation of a golf ball which remains seated in the dish will reveal defects in the ball which might otherwise go undetected. Specifically, a golf ball which is out of round will leave a gap between its surface and the edge of the dish as the ball is rotated while remaining seated in the dish. Bumps, depressions, and other surface irregularities likewise can be detected by scrutinizing a golf ball turned in rotation while seated in the dish.

The backside of the dish which faces toward the disk-shaped body of the golfing accessory is convex and projects toward the body to define a gap therebetween. The structure thus defined serves as a clip, by means of which the golfing accessory may be attached to a golfer's belt, hat, shoe, pocket, golf ball, or any other structure handy to the golfer. Moreover, the golf accessory can also be used as an attractive money clip to hold folded bills between the convex backside of the dish and the opposing flat side of the disk-shaped body of the golf accessory. Preferably, the golf accessory is formed of stamped metal with the return bent back behind the disk-shaped body so that layers of cloth or paper may be sandwiched and held therebetween. Because the dish is mounted at the terminal end of the return, the structure possesses a certain degree of resiliency or springiness, whereby the width of the gap between the convex backside of the dish and the disk-shaped body may be resiliently altered slightly to allow the golf accessory to receive articles therebetween. Preferably, the return is bent back so that a gap of about three thirty-seconds of an inch exists between the center of the convex back of the dish and the flat surface of the disk-shaped body. When the return is formed in this manner, the clip defined by the backside of the dish and the disk-shaped body is appropriate for attachment to grip clothing and leather articles normally used by golfers, and for use as a bill clip.

The loop of the return is formed as a saddle which is curved concave upwardly from the disk opposite the legs of the golf accessory. The concave curvature of the saddle is at a radius equal to the radius of a face of a golf club.

Most golf club faces are not flat, as they might appear at first glance. To the contrary, the face of a golf club has a slight convex curve from the center, typically at a radius of about 10 inches. This curvature is formed on the face of a golf club to impart an appropriate spin to the golf ball at the moment of impact of the club face against the golf ball as the ball leaves the club face during the course of a stroke. By imparting a spin to a golf ball, the ball will travel significantly farther than is the case where no spin is imparted.

As is the case with golf balls, the faces of golf clubs sometimes are deformed during use. The profile of the saddle on the return of the golf accessory of the invention is concave outwardly at a radius of a face of a golf club, typically 10 inches. If a golfer suspects that the curvature of the golf club face has become deformed during use, the golf accessory of the invention can be used to detect such deformities. To detect surface irregularities, the face of the club is placed into contact with the concave surface of the saddle. The golf accessory is moved transversely across the face of the golf club while the interface between the saddle and the golf club face is closely scrutinized. The existance of any gap between the golf club face and the concave surface of the saddle indicates to the golfer the presence of a deformity in the golf club face.

The legs of the golf accessory of the invention are typically about 1½ inches in length and are formed generally parallel to each other with a gap of about three eighths of an inch therebetween. Preferably, the legs are not rectangular in cross section, as would be the situation in the case of a divot repair tool stamped from flat sheet metal. To the contrary, when viewed in cross section each of the legs of the golf accessory defines a peak or longitudinal ridge which extends the length of the leg. The cross section of each of the legs is thus formed somewhat in the shape of a pentagon, and the longitudinal ridges allow the legs to be easily inserted into the sod of golf course greens. The minimizes any destructive effects which might result from use of the golf accessory of the invention on golf greens. The legs are preferably rounded at their tips so as not to present a safety hazard to the golfer.

In addition to providing a means for checking the geometric configuration of golf club faces, the saddle of the golfing accessory also serves as a stand upon which a golfer may rest a golf club grip to hold the grip off of a moist golf green when the club is not in use. When used in this manner the legs of the golfing accessory are merely inserted into the green in a generally vertical plane, and the golf club is laid generally transversely thereto with the grip resting atop the saddle.

The invention may be described with greater clarity and particularity by reference to the accompanying drawings.

DESCRIPTION OF THE EMBODIMENT

Figure 1:
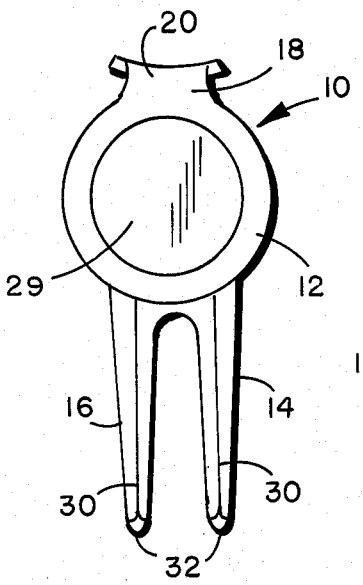
FIG. 1 is a front elevational view of the preferred embodiment of a golf accessory according to the invention.
Figure 2:
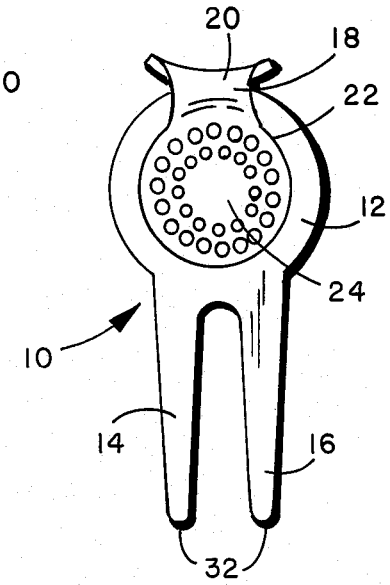
FIG. 2 is a rear elevational view of the golf accessory of FIG. 1.
Figure 3:
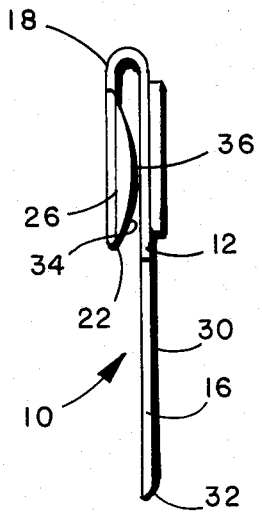
FIG. 3 is a left side elevational view of FIG. 1.
Figure 7:
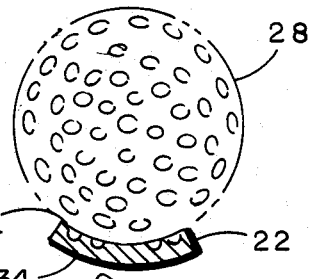
FIG. 7 illustrates diagramatically another use of the golf accessory of FIG. 1.

The drawings illustrate a stamped metal golf accessory 10 which is comprised of a flat disk-shaped body 12 having a pair of legs 14 and 16 extending therefrom generally parallel to each other. A return 18, most clearly illustrated in FIG. 3, is located diametrically opposite the legs 14 and 16. The return 18 is curved in a loop to form a saddle 20 which has a surface facing concave outwardly away from the edge of the disk-shaped body 12, as best depicted in FIGS. 1 and 2. The terminal portion of the return 18 is a dish 22 formed as a spherical segment with a concave surface 24 that faces outwardly away from the flat backside of the disk-shaped body 12. The dish 22 also includes a convex surface 26 which faces toward and is located directly behind the backside of the disk-shaped body 12. The concave surface 24 of the dish 22 has a radius of curvature equal to the radius of curvature of a golf ball 28, as illustrated in FIG. 7.

The body 12 of the golf accessory 10 is a planar, flat piece of stamped metal. If desired, a smaller disk-shaped centerpiece 29 may be provided. The centerpiece 29 may bear a decorative emblem and/or a legend commemorating a particular country club or golf tournament. The centerpiece 29 is preferably welded or glued to the center of the front surface of the body 12.

The legs 14 and 16 are formed from the same flat metal stock as the body 12 and are coplanar therewith. The legs 14 and 16 are about 1½ inches long, as measured from their junction, and define a gap of about three eighths of an inch therebetween. The legs are generally parallel to each other, although they may converge slightly. The legs 14 and 16 are not truly rectangular in cross section. To the contrary, they are formed with longitudinal ridges 30 extending along their lengths. The longitudinal ridges 30 are provided to facilitate insertion of the legs 14 and 16 into the green in order for the tool 10 to be used to effectuate divot repair. The tips of the legs 14 and 16 are rounded at 32 so as to avoid presenting a safety hazard to the golfer.

The return 18 which forms the saddle 20 is bent in a loop from the disk-shaped body 12. The neck of the return 18 forms the saddle 20, while the terminal portion of the return 18 broadens and forms the dish 22, which is carried in cantilevered fashion relative to the body 12.

As viewed in FIGS. 1 and 2, the saddle spans a distance of eleven sixteenths of an inch and is formed concave outwardly and is profiled to curve in a circular arc at a radius equal to the radius of curvature of a face of a golf club. Preferably, the concave radius of curvature of the surface of the saddle 20, as viewed in FIGS. 1 and 2, is a radius of 10 inches. The saddle 20 can then be placed into contact with the face of a golf club head. The interface between the outwardly facing surface of the saddle 20 and the face of a golf club head is then closely scrutinized from the vantage point of FIG. 1 or 2. Any gap at the interface will indicate a surface deformity or irregularity in the golf club face. The golfer is thus able to quickly and easily check a golf club face for deformity or defects before playing, or before an important shot.

Figure 6:
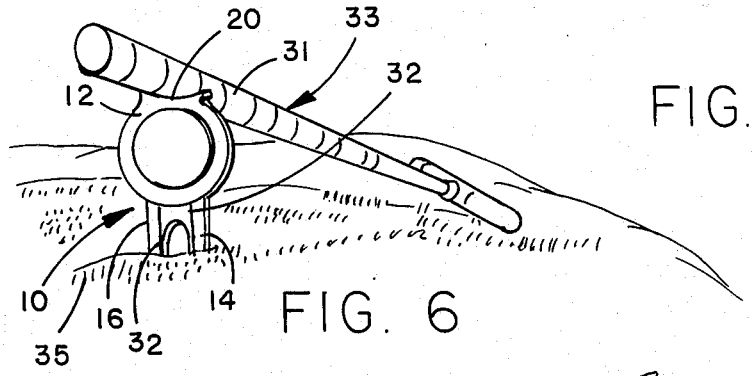
FIG. 6 illustrates one use of the golf accessory of FIG. 1.

The saddle 20 may also be used to support the grip 31 of a golf club 33, as illustrated in FIG. 6. The golf accessory may be used to hold the grip 31 up away from moist grass 35 on a green or fairway. The legs 14 and 16 are inserted into the sod as illustrated to hold the accessory 10 upright in a generally vertical disposition. The golf club 35 is then laid transversely to the plane of the accessory 10 with the golf club grip 31 resting atop the saddle 20. The grip 31 is thereby held out of the grass and will not become wet due to ground mosture.

Figure 8:
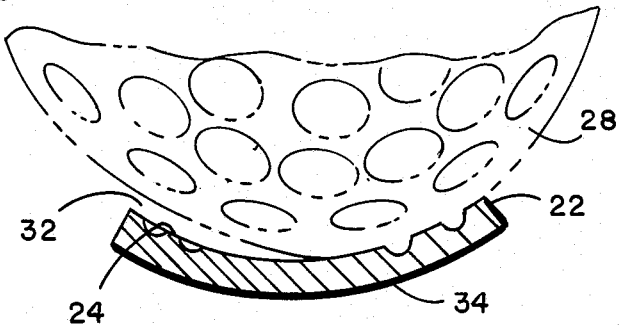
FIG. 8 is an enlarged detail of FIG. 7.
Figure 9:
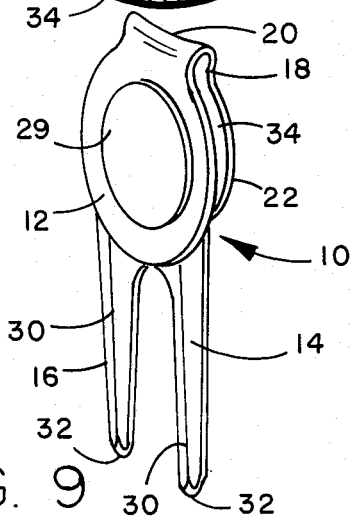
FIG. 9 is a perspective view of the golf accessory of FIG. 1.

The terminal end of the return 18 forms the dish 22. The dish 22 is preferably about seven eighths of one inch across, as viewed in FIGS. 2, 7 and 8, and is formed as a segment of a sphere at a radius of 0.84 inches. That is, the concave surface 24 of the dish 22 is a spherical segment having a radius equal to the radius of a golf ball 28, as best depicted in FIGS. 7 and 8. The surface 24 of the dish 22 may be textured with a multiplicity of circular depressions, as illustrated in FIG. 2, to serve as a reminder of the function of the dish 22.

The dish 22 may be used to check a golf ball 28 for surface irregularities in the manner depicted in FIGS. 7 and 8. To check the golf ball 28, the ball 28 is placed cradled in the dish 22 in contact with the concave surface 24 thereof. The ball 28 is then rotated while remaining cradled on the surface 24. If the ball is out of round, for example, a portion of the golf ball 28 will no longer rest flush against the surface 24 of the dish 22. To the contrary, a noticeable gap 32 will appear between the surface of the ball 28 and the concave surface 24 of the dish 22 as the ball is rotated, as depicted in FIG. 8. A golfer is thus informed of any irregularity in the golf ball configuration which, in all likelihood, would otherwise adversely affect subsequent shots.

Figure 5:
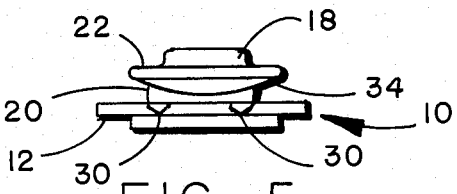
FIG. 5 is a bottom plan view of the golf accessory of FIG. 1.
Figure 4:
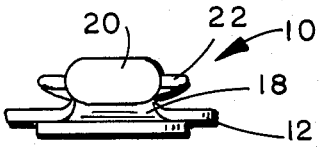
FIG. 4 is a top plan view of the golf accessory of FIG. 1.

As best illustrated in FIG. 3, the dish 22 has a convex backside 34 which faces toward the flat surface of the backside of the disk-shaped body 12 and projects theretoward to define a gap 36 therebetween. Preferably, the gap 36 is about three thirty-seconds of an inch between the center of the convex surface 34 and the facing flat back surface of the disk-shaped body 12, as depicted in FIGS. 3 and 5. Because the dish 22 is mounted in cantilevered fashion at the terminal end of the return 18, there is a certain degree of resiliency between the dish 22 and the disk-shaped body 12. The backside of the disk-shaped body 12 and the convex surface 34 thereby define a clip which may easily receive and grip articles therebetween. This allows the clip, so defined, to be attached to a golfer's belt, shoe, pocket, cap or other article of clothing. As previously noted, the clip so defined may also serve as a money clip for gripping folded bills.

The combination clip and golf accessory of the invention is an extremely useful and versatile device which serves as an invaluable aid to golfers. Undoubtedly, numerous variations and modifications of the invention will become readily apparent to those familiar with golf accessories. Accordingly, the scope of the invention should not be construed as limited to the specific embodiment depicted and described, but rather is defined in the claims appended hereto.

I claim:

1. A combination clip and golfing accessory comprising a metal disk having a pair of thin, longitudinal legs lying in the plane of said disk and spaced from each other, a saddle curved concave upwardly and extending rearwardly from said disk opposite said legs and terminating in a spherical segment with a convex surface facing forwardly toward said disk and a concave surface facing rearwardly directly behind said disk and formed at a radius equal to the radius of a golf ball.

2. A combination clip and golfing accessory according to claim 1 wherein said legs are each formed with a longitudinal ridge therealong and are rounded at their tips.

3. A combination clip and golfing accessory according to claim 1 wherein the concave curvature of said saddle is at a radius equal to the radius of a face of a golf club.

4. A stamped golf accessory comprising a flat disk-shaped body having a pair of legs extending therefrom and defining a return located diametrically opposite said legs, said return forming a saddle which is concave outwardly, and a spherical segment with a convex surface facing toward and located directly behind said body and a rearwardly facing concave dish having a surface with a radius of curvature equal to the radius of curvature of a golf ball.

5. A stamped golf accessory according to claim 4 formed of metal and in which said concave disk is seven eighths of one inch across.

6. A stamped golf accessory according to claim 4 in which said concave dish is formed at a radius of 0.840 inches.

7. A stamped golf accessory according to claim 4 in which said saddle is formed concave outwardly at a radius of ten inches.

8. A stamped golf accessory according to claim 4 in which said legs both have longitudinal ridges running their lengths and are rounded at their tips.

9. A stamped golf accessory according to claim 4 in which said saddle spans a distance of eleven sixteenths of an inch.

10. A stamped golf accessory according to claim 4 in which said concave dish is textured with a multiplicity of circular depressions.

11. A metal golf accessory formed with a disk-shaped body having a pair of elongated, generally parallel legs on one side and a return defined on an opposite side bent to form a loop with an outwardly facing concave saddle and terminating in a dish located directly behind said body and facing outwardly therefrom and formed at a spherical radius equal to the radius of a golf ball.

12. A golf accessory according to claim 11 wherein said concave saddle has a profile curved in a circular arc at a radius equal to the radius of curvature of a face of a golf club.

13. A golf accessory according to claim 12 wherein said radius of curvature of said golf club face is 10 inches.

14. A golf accessory according to claim 11 in which said dish has a convex backside facing toward said body and projecting theretoward to define a gap therebetween.

15. A golf accessory according to claim 11 in which said dish is formed as a spherical segment having a radius equal to the radius of a golf ball.

* * * * *